United States Patent [19]

Yoshioka et al.

[11] Patent Number: 4,849,055

[45] Date of Patent: Jul. 18, 1989

[54] PROCESS FOR MAKING PAPER USING A SUBSTITUTED SUCCINIC ANHYDRIDE AS A SIZING AGENT

[75] Inventors: Shigehiko Yoshioka, Akashi; Hideto Yamada, Kobe; Akira Honma, Nagaoka; Hisatake Sato, Yokohama, all of Japan

[73] Assignees: Seiko Kagaku Kogyo Co., Ltd.; Hokuetso Paper Mills, Ltd.; Nippon Oil Co., Ltd., all of Japan

[21] Appl. No.: 71,935

[22] Filed: Jul. 10, 1987

[30] Foreign Application Priority Data

Jul. 22, 1986 [JP] Japan ..... 61-172504

[51] Int. Cl.[4] ..... D21H 3/08

[52] U.S. Cl. ..... 162/158; 162/175; 162/181.6; 162/183

[58] Field of Search ..... 162/158, 179, 181.6, 162/183, 175

[56] References Cited

U.S. PATENT DOCUMENTS

| | | | |
|---|---|---|---|
| 3,102,064 | 8/1963 | Wurzburg . | |
| 3,968,005 | 7/1976 | Wurzburg | 162/158 |
| 4,385,961 | 5/1983 | Svending et al. | 162/181.6 |
| 4,545,855 | 10/1985 | Sweeney | 162/158 |
| 4,717,452 | 1/1988 | Yoshioka et al. | 162/158 |

FOREIGN PATENT DOCUMENTS

| | | |
|---|---|---|
| 1186857 | 5/1985 | Canada . |
| 41056 | 12/1981 | European Pat. Off. . |
| 803358 | 10/1980 | Finland . |
| 392305 | 9/1961 | Japan . |
| 2006744 | 5/1979 | United Kingdom . |
| 1601464 | 10/1981 | United Kingdom . |

OTHER PUBLICATIONS

Casey, *Pulp and Paper*, 3rd ed., vol. III, (1981), pp. 1491–1494.

Abstracts Bulletin of the Institute of Paper Chemistry, vol. 57, No. 1, Jul. 1986, p. 134, Abstract No. 1087.

Chemical Abstracts, vol. 103, No. 4, Jul. 29, 1985, p. 79, Abstract No. 24007d.

Abstract Bulletin of the Institute of Paper Chemistry, vol. 54, No. 11, May 1984, p. 1340, Abstract No. 12666.

Abstract Bulletin of the Institute of Paper Chemistry, vol. 54, No. 3, Sep. 1983, p. 350, Abstract No. 3226.

Abstract Bulletin of the Institute of Paper Chemistry, vol. 55, No. 2, Aug. 1984, pp. 245–246, Abstract No. 2297.

Abstract Bulletin of the Institute of Paper Chemistry, vol. 57, No. 1, Jul. 1986, p. 134, Abstract No. 1087.

Kaimen-Kasseizai Binran, pp. 20–21, Jul. 5, 1960.

Organic Chemistry, 3rd Ed., Fieser et al., pp. 188–189, 1956.

*Primary Examiner*—Peter Chin

*Attorney, Agent, or Firm*—Oliff & Berridge

[57] ABSTRACT

A process for making paper using a substituted succinic anhydride as a sizing agent which has the steps of preparing pulp slurry containing (a) an aqueous dispersion of a substituted succinic anhydride in which a cationic tapioca starch containing at least 0.3 percent by weight of basic nitrogen is added and mixed, and (b) a colloidal silica, and forming a paper sheet to improve the retentions of a fine fiber and a filler in the pulp slurry in the sheet forming step and to largely suppress the operation of decreasing the sizing performance of the substituted succinic anhydride with the colloidal silica (b) added as the retention aid, thereby preparing sheet paper having excellent sizing effect. Thus, the process for making paper can not only remarkably reduce the sizing cost but can also efficiently utilize the fine fiber and the filler in the pulp slurry.

7 Claims, No Drawings

PROCESS FOR MAKING PAPER USING A SUBSTITUTED SUCCINIC ANHYDRIDE AS A SIZING AGENT

BACKGROUND OF THE INVENTION

The present invention relates to a process for making using a substituted succinic anhydride as a sizing agent, which can provide a preferable sizing effect to be achieved by a substituted succinic anhydride and high retentions of a fine fiber and a filler in a pulp slurry.

There is known a process for making paper employing as a sizing agent a substituted succinic anhydride, and a process for sizing paper by adding an aqueous dispersion, prepared by dispersing a substituted succinic anhydride in water with the aid of a suitable dispersant, to a pulp slurry.

There are also known as a dispersant, in the case of preparing the aqueous dispersion of the substituted succinic anhydride, processes employing a cationic starch (disclosed in Japanese Patent Publication No. 2305/1964, Japanese Patent Laid-open No. 197397/1978 official gazettes), a cationic or ampholytic synthetic polymer substance (disclosed in Japanese Patent Laid-open No. 45730/1983, Japanese Patent Laid-open No. 120897/1983 official gazettes), and various surface active substances (disclosed in Japanese Patent Publication No. 36044/1978, Japanese Patent Laid-open No. 87397/1983, Japanese Patent Laid-open No. 220897/1983, Japanese Patent Laid-open No. 47498/1984, Japanese Patent Laid-open No. 187696/1984, Japanese Patent Laid-open No. 28598/1985 official gazettes).

It is, on the other hand, known to add a retention aid in a pulp slurry to improve the retention of fine fiber and a filler in the pulp slurry in a process for forming a sheet of paper from the pulp slurry. For example, there is know as a general retention aid cationic polymer substances such as cationic starch, cationic polyacrylamide, polyethylene-imine, polyamide-polyamine, etc. Recently, a process for making paper for remarkably improving the retention of a fine fiber and a filler in the pulp slurry by employing both a cationic starch or cationic or ampholytic Guar Gum and a colloidal silica has been proposed (disclosed in Japanese Patent Laid-open No. 51900/1982, Japanese Patent National Publication No. 502004/1983 official gazettes).

The inventors of the present invention have studied the operation and the advantages of improving the retentions of a fine fiber and a filler in a pulp slurry prepared by adding a colloidal silica in the pulp slurry in a sheet formation. It has been confirmed that, when the colloidal silica is added in the pulp slurry after sizing paper by adding an aqueous dispersion of a substituted succinic anhydride in the pulp slurry, the retentions of a fine fiber and a filler in the pulp slurry in a sheet formation are significantly improved, but the inventors have also discovered that the sizing effect of the prepared paper exhibited much more deterioration than when the colloidal silica is not added. In a process for making paper using as a papermaking sizing agent a substituted succinic anhydride, the addition of the colloidal silica as a retention aid of the fine fiber and the filler of the pulp slurry causes the sizing effect of the substituted succinic anhydride to decrease. The operation for decreasing the sizing performance of the substituted succinic anhydride with the colloidal silica becomes higher when the steps of adding the aqueous dispersion of the substituted succinic anhydride in the pulp slurry and the step of then adding the colloidal silica become closer. If these steps are reversed in sequence for adding them in the pulp slurry, the decrease in the sizing performance is suppressed to a relatively low value, but cannot be completely eliminated. Other problems such as the decrease in the retention aiding action of a fine fiber and a filler in the pulp slurry with the colloidal silica and the decrease in the drainage of the pulp slurry have been discovered when the decreasing action of the sizing performance of the substituted succinic anhydride with the colloidal silica is suppressed to a low value.

SUMMARY OF THE INVENTION

The present invention provides a process for making paper using a substituted succinic anhydride as a sizing agent and improving the retentions of a fine fiber and a filler in a pulp slurry at a sheet forming step by adding a colloidal silica in the pulp slurry containing the sizing agent of the substituted succinic anhydride comprising the step of adding the sizing agent of the substituted succinic anhydride by adding an aqueous disperson of a substituted succinic anhydride stabilized in the aqueous disperson of the substituted succinic anhydride by adding and mixing a cationic tapioca starch containing at least 0.3 percent by weight of a basic nitrogen, i.e., in the presence of a cationic tapioca starch containing at least 0.3 percent by weight of a basic nitrogen. Thus, the present invention can suppress a decrease in sizing performance of the substituted succinic anhydride with the colloidal silica and can also eliminate a decrease in operation of improving the retentions of the fine fiber and the filler in the pulp slurry with the colloidal silica.

In the process for making paper according to the present invention constituted as described above, the substituted succinic anhydride used as a sizing agent may employ all the substituted succinic anhydrides known heretofore as sizing agents. More particularly, substituted succinic anhydrides which contain a hydrophobic hydrocarbon group having at least 8 carbon atoms and more preferably 12 to 36 carbon atoms such as alkyl groups or alkenyl groups, etc. are employed. The substituted succinic anhydrides can be generally readily produced by addition reaction of olefins such as L-olefins, inner olefins or their mixture having carbon atoms of corresponding number and maleic anhydrides.

The cationic tapioca starch used to stabilize the substituted succinic anhydride in the aqueous dispersion of the substituted succinic anhydride is a cationic tapioca starch which contains at least 0.3 percent by weight of one or more types of basic nitrogens selected from a group consisting of primary, secondary and tertiary amine groups and quaternary ammonium groups. When the basic nitrogen atom is a nitrogen atom by the quaternary ammonium group, the effect is largest. The cationic tapioca starch which contains less than 0.3 percent by weight of basic nitrogen, or cationic starches except the tapioca starch such as cationic starch prepared from wheat starch, potato starch can insufficiently suppress a decrease in the sizing performance of the substituted succinic anhydride with the colloidal silica or disables the suppression. However, when a dispersant of another type of cationic starch, cationic or ampholytic synthetic polymer substance, or surfactant is added to the aqueous dispersion of the substituted succinic anhydride which mixes the cationic tapioca starch containing at least 0.3 percent by weight of basic nitrogen therein, the operation by the cationic tapioca starch does not decrease. Therefore, the cationic tapioca starch and other dispersant can be contained together in the aqueous disperson of the substituted succinic anhydride.

The ratio of the substituted succinic anhydride to the cationic tapioca starch in the aqueous dispersion of the substituted succinic anhydride is 0.5 to 50 parts by weight and more preferably 1 to 5 parts by weight to 1 part by weight of the substituted succinic anhydride. In the aqueous dispersion which contains both the substituted succinic anhydride and the cationic tapioca starch, fine particles of the substituted succinic anhydride are dispersed and stabilized in the aqueous solution of the cationic tapioca starch. The aqueous dispersant which contains both the substituted succinic anhydride and the cationic tapioca starch can be readily prepared by mixing the preliminary mixture of the substituted succinic anhydride or the substituted succinic anhydride and a surfactant in the aqueous solution in which the cationic tapioca starch is dissolved in advance, and agitating and homogenizing the mixture as required.

The colloidal silica used in the papermaking process according to the present invention contains 50 or less millimicrons in a particle diameter and more preferably 20 or less millimicrons such as "Snowtex (trade name)" (produced by Nissan Chemical Industries, Ltd., Japan) sold in the market as colloidal silica containing 50 or less millimicrons in particle diameter to be used preferably.

The pulp slurry used in the papermaking process according to the present invention preferably contains 0.03 to 3 percent by weight of substituted succinic anhydride and 0.01 to 1 percent by weight of colloidal silica of $SiO_2$ with respect to dry weight of pulp in the pulp slurry, and the pulp slurry in which general other papermaking additives are properly added in addition to the substituted succinic anhydride and the colloidal silica can ordinarily be used, of course.

The papermaking process of the present invention arranged as described herein-above is widely applicable to all papermaking of sheet formation from the pulp slurry irrespective of the types of the pulp, and remarkable operation and advantages can be provided by the case of so-called neutral or alkaline papermaking process by adding a filler of calcium carbonate.

EXAMPLES

Hereinafter, the present invention will be described further in detail by the preferred examples of the papermaking process according to the present invention together with the provided advantages.

EXAMPLE 1

(1) Preparation of aqueous dispersion of substituted succinic anhydride 2.5 parts by weight of preliminary mixture of 95 percent by weight of alkenyl substituted succinic anhydride (the mixture of 15 to 18 carbon atoms of alkenyl substituting group, hereinafter referred to as "ASA") and 5 percent by weight of polyoxyethylenenonylphenylether phosphoric ester (9 mols of oxyethylene unit in polyoxyethylene group) was added to 100 parts by weight of aqueous solution of 5 percent by weight of cationic tapioca starch containing 0.31 percent by weight of quaternary basic nitrogen, the resultant mixture was set in a homogeneous mixer (model HV-M manufactured by Tokushu Kika Kogyo K.K., Japan), agitated and emulsified at 100 V for 2 min., the resultant emulsion was diluted with 2 percent by weight of aqueous solution of cationic tapioca starch containing 0.31 percent by weight of quaternary basic nitrogen, and aqueous dispersion containing 0.5 percent by weight of ASA was prepared. (2) Papermaking process 0.1 percent by weight of aluminium sulfate (to dry pulp weight, hereinafter referred similarly) and 30 percent by weight of ground calcium carbonate were added to and mixed with 1 percent of aqueous slurry of beaten pulp (L-BKP: C.S.F: 360 cc), aqueous dispersion of substituted succinic anhydride prepared in the above paragraph 1) was added by an equivalent of 0.15 percent by weight of ASA of the aqueous dispersion, and the mixture was sufficiently mixed and dispersed. Then, 0.1 percent by weight (converted by $Si0_2$) of colloidal silica (Snowtex X having 7 to 9 millimicrons of particle diameter: manufactured by Nissan Chemical Industries, Ltd., Japan) was added, and paper was prepared in accordance with the ordinary process with TAPPI Standard sheet machine, and manual paper of the weight of 80 $g/m^2$ was prepared.

COMPARISON EXAMPLE 1

Similar steps to those in the EXAMPLE 1 were repeated except the omission of the step of adding colloidal silica in the paragraph (2) of the EXAMPLE 1, and manual paper was prepared for comparison.

EXAMPLE 2

Similar steps to those in the EXAMPLE 1 were repeated except the use of cationic tapioca starch containing 0.42 percent by weight of quaternary basic nitrogen instead of the use of cationic tapioca starch in the paragraph (1) of the EXAMPLE 1, and manual paper was prepared.

COMPARISON EXAMPLE 2

Similar steps to those in the EXAMPLE 2 were repeated except the omission of the step of adding colloidal silica in the EXAMPLE 2, and manual paper was prepared for comparison.

COMPARISON EXAMPLE 3

Similar steps to those in the EXAMPLE 1 were repeated except the use of cationic tapioca starch containing 0.22 percent by weight of quaternary basic nitrogen instead of the use of cationic tapioca starch in the paragraph (1) of the EXAMPLE 1 and the omission of adding the colloidal silica in the paragraph (2) of the EXAMPLE 1, and manual paper was prepared for comparison.

COMPARISON EXAMPLE 4

Similar steps to those in the EXAMPLE 1 were repeated except the use of cationic tapioca starch containing 0.22 percent by weight of quaternary basic nitrogen instead of the use of cationic tapioca starch in the paragraph (1) of the EXAMPLE 1, and manual paper was prepared for comparison.

COMPARISON EXAMPLE 5

Similar steps to those in the EXAMPLE 1 were repeated except the use of cationic potato starch containing 0.35 percent by weight of quaternary basic nitrogen instead of the use of cationic tapioca starch in the paragraph (1) of the EXAMPLE 1 and the omission of adding the colloidal silica in the paragraph (2) of the EXAMPLE 1, and manual paper was prepared for comparison.

COMPARISON EXAMPLE 6

Similar steps to those in the EXAMPLE 1 were repeated except the use of cationic potato starch containing 0.35 percent by weight of quaternary basic nitrogen instead of the use of cationic tapioca starch in the paragraph 1) of the EXAMPLE 1, and manual paper was prepared for comparison.

COMPARISON EXAMPLE 7

Similar steps to those in the EXAMPLE 1 were repeated except the use of cationic corn starch containing 0.34 percent by weight of quaternary basic nitrogen instead of the use of cationic tapioca starch in the paragraph (1) of the EXAMPLE 1 and the omission of adding the colloidal silica in the paragraph (2) of the EXAMPLE 1, and manual paper was prepared for comparison.

COMPARISON EXAMPLE 8

Similar steps to those in the EXAMPLE 1 were repeated except the use of cationic corn starch containing 0.34 percent by weight of quaternary basic nitrogen instead of the use of cationic tapioca starch in the paragraph (1) of the EXAMPLE 1, and manual paper was prepared for comparison.

COMPARISON EXAMPLE 9

Similar steps to those in the EXAMPLE 1 were repeated except the use of cationic sweet potato starch containing 0.35 percent by weight of quaternary basic nitrogen instead of the use of cationic tapioca starch in the paragraph (1) of the EXAMPLE 1 and the omission of adding the colloidal silica in the paragraph (2) of the EXAMPLE 1, and manual paper was prepared for comparison.

COMPARISON EXAMPLE 10

Similar steps to those in the EXAMPLE 1 were repeated except the use of cationic sweet potato starch containing 0.35 percent by weight of quaternary basic nitrogen instead of the use of cationic tapioca starch in the paragraph (1) of the EXAMPLE 1, and manual paper was prepared for comparison.

The dispersed particle diameter of ASA in the ASA aqueous dispersion, Stö ckigt sizing degree (according to JIS (Japanese Industrial Standards) P-8122) of the prepared manual paper, Stöckigt sizing degree retentivity and the retention of calcium carbonate in the manual paper in the above-mentioned EXAMPLES and COMPARISON EXAMPLES are listed in Table 1.

The Stöckigt ckigt sizing degree retentivity is obtained by the following formula by the ratio of the Stöckigt ckigt sizing degrees of the manual papers prepared by the sheet formation from two types of pulp slurries having difference of only whether the colloidal silica was added to the pulp slurry or not $$\frac{\text{(Sizing degree of manual paper with colloidal silica)}}{\text{(Sizing degree of manual paper without colloidal silica)}} \times 100$$

and the retention of calcium carbonate in the manual paper is obtained by the following formula $$\frac{\text{(Weight of manual paper)} \times \text{(wt \% of ash in manual paper)}}{\text{(Weight of } CaCO_3 \text{ in pulp slurry)}} \times \frac{1}{0.564}\left(\frac{CaCO_3}{CaO}\right) \times 100$$

TABLE 1

| | Dispersed particle dia. of ASA aqueous dispersion (micron) | Stockigt sizing degree (sec.) | Manual paper Sizing retentivity (%) | Retention of $CaCO_3$ (%) |
|---|---|---|---|---|
| C. Example 1 | 0.5 | 32.2 | | 47.9 |
| Example 1 | 0.5 | 25.7 | 79.8 | 59.5 |
| C. Example 2 | 0.5 | 34.0 | | 48.8 |
| Example 2 | 0.5 | 26.6 | 78.2 | 61.2 |
| C. Example 3 | 0.5 | 29.5 | | 38.4 |
| C. Example 4 | 0.5 | 19.1 | 64.7 | 49.5 |
| C. Example 5 | 1.5 | 27.7 | | 41.2 |
| C. Example 6 | 1.5 | 10.5 | 37.9 | 53.3 |
| C Example 7 | 1.0 | 25.4 | | 40.7 |
| C. Example 8 | 1.0 | 7.3 | 28.7 | 49.8 |
| C. Example 9 | 1.0 | 28.1 | | 42.0 |
| C. Example 10 | 1.0 | 9.3 | 33.1 | 51.5 |

The operation and the mechanism of the colloidal silica for decreasing the sizing effect executed by the substituted succinic anhydride to improve the retentions of the fine fiber and the filler in the pulp slurry in sheet forming step in the papermaking process for forming a sheet from the pulp slurry have not yet been clearly concluded. However, it is confirmed that, when the cationic tapioca starch which contains at least 0.3 percent by weight of basic nitrogen as a dispersant of the substituted succinic anhydride is selected and utilized in case of preparing the aqueous dispersion of the substituted succinic anhydride, the degree of reducing the sizing performance of the substituted succinic anhydride with the above-mentioned colloidal silica can be largely suppressed, and such operation of the aqueous dispersion of the substituted succinic anhydride with the aid of the cationic tapioca starch as a dispersant is presumed that the dispersant has excellent chemical stability. Further, it is also confirmed that the dispersed particle diameters of the aqueous dispersion of the substituted succinic anhydride with the aid of the cationic tapioca starch as a dispersant become more fine and uniform when the dispersing conditions are equal to the aqueous dispersion of the substituted succinic anhydride with the aid of other cationic starches as a dispersant. This cause is also presumed to be the same cause as the large suppression of the decreasing degree of the sizing performance prepared by the substituted succinic anhydride by the addition of the colloidal silica by obtaining the effectively sizing degree in the papermaking process according to the present invention, i.e., by using the aqueous dispersion of the substituted succinic anhydride with the aid of the cationic tapioca starch as a dispersant.

The process for making paper according to the present invention comprises the step of preparing pulp slurry containing (a) an aqueous dispersion of a substituted succinic anhydride in which a cationic tapioca starch containing at least 0.3 percent by weight of basic nitrogen is added and mixed, and (b) a colloidal silica to improve the retentions of a fine fiber and a filler in the pulp slurry in the sheet forming step and to largely suppress the operation of decreasing the sizing performance of the substituted succinic anhydride with the colloidal silica (b) added as the retention aid, thereby preparing sheet paper having excellent sizing effect.

Therefore, the process for making paper according to the present invention can not only remarkably reduce the sizing cost but can also efficiently utilize the fine fiber and the filler in the pulp slurry and yet can reduce the wear of wires due to the filtration of the filler in the sheet forming step, can improve the sheet forming operability due to the improvement in the drainage of the wires, and can provide the reduction in the energy for drying to provide useful industrial values.

What is claimed is:

1. A process for making paper using a substituted succinic anhydride as a sizing agent and a cationic starch as dispersion, comprising the steps of:

adding (a) an aqueous dispersion of a substituted succinic anhydride in which a cationic tapioca starch containing at least 0.3% by weight of basic nitrogen is added and mixed and (b) a colloidal silica into a pulp slurry, and then forming a sheet from the pulp slurry, wherein said basic nitrogen is a basic nitrogen of a quaternary ammonium group;

a ratio of the substituted succinic anhydride to the cationic tapioca starch in the aqueous dispersion of the substituted succinic anhydride is 0.5 to 50 parts by weight of cationic tapioca starch to 1 part by weight of the substittued succinic anhydride;

said pulp slurry contains 0.03 to 3% by weight of substituted succinic anhydride with respect to dry weight of pulp in the pulp slurry; and said pulp slurry contains 0.01 to 1% by weight of $SiO_2$ of colloidal silica with respect to dry weight for pulp in the pulp slurry.

2. The process according to claim 1, wherein said substituted succinic anhydride has a hydrophobic hydrocarbon group containing at least 8 carbon atoms.

3. The process according to claim 2, wherein said substituted succinic anhydride has a hydrophobic hydrocarbon group containing 12 to 36 carbon atoms.

4. The process according to claim 2, wherein said hydrophobic hydrocarbon group is an alkyl or alkenyl group.

5. The process according to claim 1, wherein the ratio of the substituted succinic anhydride to the cationic tapioca starch in the aqueous dispersion of the substituted succinic anhydride is 1 to 5 parts by weight of cationic tapioca starch to 1 part by weight of the substituted succinic anhydride.

6. The process according to claim 1, wherein the particle diameter of said colloidal silica is 50 or less millimicrons.

7. The process according to claim 6, wherein the particle diameter of said colloidal silica is 20 or less millimicrons.

* * * * *